United States Patent [19]

Mazzeschi

[11] Patent Number: 4,911,562

[45] Date of Patent: Mar. 27, 1990

[54] COLLAPSIBLE CAN WITH A HANDLE ARRANGEMENT FOR POURING THE LIQUID HELD THEREIN

[76] Inventor: Adriano Mazzeschi, Via C. Romani, 56, 20091 Bresso (Milano), Italy

[21] Appl. No.: 167,331

[22] Filed: Mar. 14, 1988

[30] Foreign Application Priority Data

Mar. 17, 1987 [IT] Italy ..... 21153/87[U]

[51] Int. Cl.[4] ..... B65D 33/10

[52] U.S. Cl. ..... 383/16; 383/10; 383/13; 383/91; 383/906

[58] Field of Search ..... 383/16, 904, 6, 7, 10, 383/13, 91, 906; 222/527, 528, 530

[56] References Cited

U.S. PATENT DOCUMENTS

| | | | |
|---|---|---|---|
| 43,567 | 7/1864 | Campbell | 383/10 |
| 994,287 | 6/1911 | Thorning | 383/906 |
| 1,089,279 | 3/1914 | Simer et al. | 383/906 |
| 1,183,962 | 5/1916 | Eggers | 383/904 |
| 1,596,355 | 8/1926 | Hirsch | 383/906 |
| 1,623,107 | 4/1927 | Goddykoontz | 383/904 |
| 1,654,921 | 1/1928 | Critelli | 383/906 |
| 2,273,128 | 2/1942 | Madsen et al. | 383/91 |
| 2,438,351 | 3/1948 | Spanel | 383/904 |
| 2,446,308 | 8/1948 | Smith | 383/906 |
| 2,866,488 | 12/1958 | Thompson | 383/91 |
| 3,642,189 | 2/1972 | Widenback | 383/7 |

*Primary Examiner*—Stephen P. Garbe

*Attorney, Agent, or Firm*—Bucknam and Archer

[57] ABSTRACT

The collapsible can comprises two layers of a flexible plastics material which are coupled at the perimeter thereof and define a pouring mouth arranged at the end of an elongated portion, at least a gripping handle being provided at a peripheral edge defined by the two plastics layers.

4 Claims, 2 Drawing Sheets

COLLAPSIBLE CAN WITH A HANDLE ARRANGEMENT FOR POURING THE LIQUID HELD THEREIN

BACKGROUND OF THE INVENTION

The present invention relates to a collapsible can provided with handle means for facilitating the pouring of the liquid held therein.

There are already known and commercially available collapsible cans which are provided with deformable walls so as to reduce their size as they are not used.

These known cans generally comprise bellows and the like portions which afford the possibility of partially reducing the can size. However because of a rather great residual volume, these known cans can not be completely folded.

Other known collapsible cans substantially consist of bag elements, made of plastics film materials which present the advantage of reducing the residual volume to a very small amount in the not use condition: however, these collapsible cans can not be easily handled for use purposes.

In fact the liquid held in these cans can be hardly poured since these cans do not have a well defined shape.

SUMMARY OF THE INVENTION

Thus, the task of the present invention is to overcome the above mentioned drawbacks, by providing a collapsible can, having gripping handle means for pouring the liquid held therein, which is capable of assuming a very reduced volume, as the can is not used, while affording the possibility of precisely pouring the liquid held therein.

Within the scope of the above mentioned task, a main object of the present invention is to provide a collapsible can which can be stored in a very reduced space while having a comparatively high capacity.

Another object of the present invention is to provide a collapsible can which is very reliable and safe in operation.

Yet another object of the present invention is to provide a collapsible can which may be constructed starting from easily commercially available materials and which, moreover, has a comparatively low cost.

According to one aspect of the present invention, the above task and objects, as well as yet other objects, which will become more apparent thereinafter, are achieved by a collapsible can provided with gripping handle means for facilitating the pouring of the liquid held therein, characterized in that it comprises two layers of flexible plastics material which are coupled at the perimeter thereon and define a pouring mouth arranged at the end of an elongated portion.

Moreover, the can comprises at least a gripping handle member, formed at a peripheral edge defined by the mentioned layers, near the elongated portion, as well as closure means adapted for removable association to said mouth.

BRIEF DESCRIPTION OF THE DRAWINGS

Further characteristics and advantages will become more apparent from the following detailed description of a preferred embodiment of a collapsible can, according to the invention, including gripping handle means for facilitating the pouring of the liquid held therein, which is illustrated, by way of a not limitative example, in the accompanying drawings, where.

DESCRIPTION OF THE PREFERRED EMBODIMENTS

Figure 7:
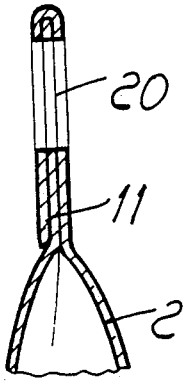
FIG. 7 is a cross-sectional view, on an enlarged scale, through one of the can handles and a thickened portion of the top can edge.
Figure 1:
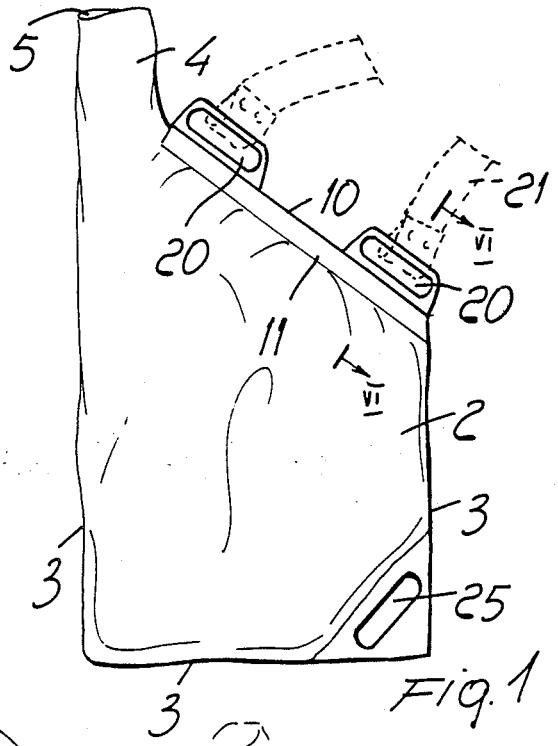
FIG. 1 schematically illustrates the collapsible can according to the present invention.
Figure 3:
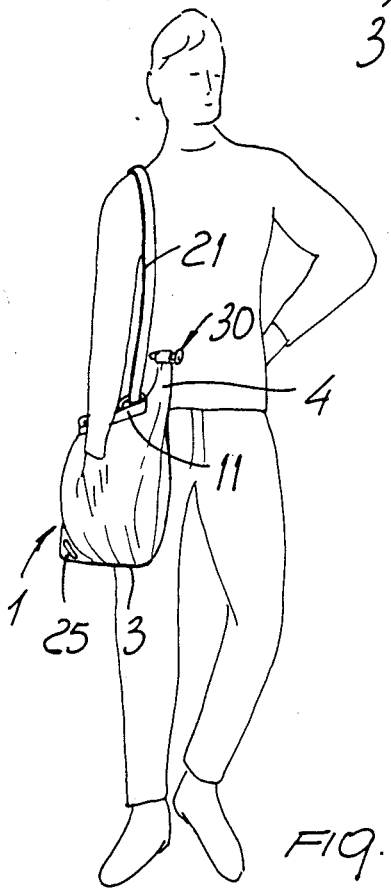
FIG. 3 illustrates the collapsible can according to the invention supported by a user shoulder.
Figure 2:
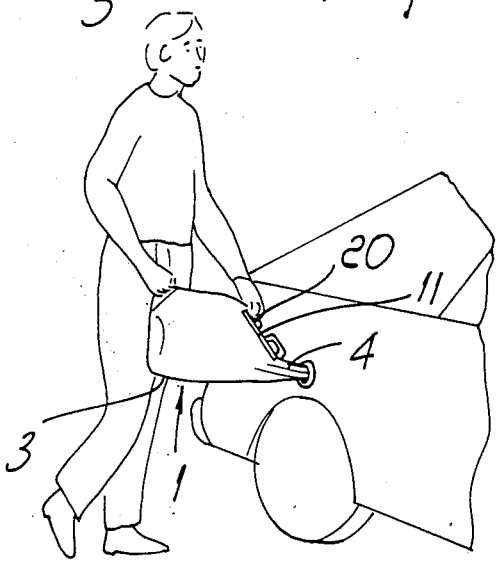
FIG. 2 illustrates the subject collapsible can in its use condition, for example for pouring a fuel liquid.

With reference to the mentioned figures, the collapsible can, with gripping handle means for facilitating the pouring of the liquid held therein, according to the invention, has been generally indicated at the reference number 1 and comprises two flexible plastics material layers 2 or, possibly, a single folded plastics material layer, said layers being coupled at their perimetrical edges 3 so as to define a substantially rectangular closed element extending with an elongated portion 4 ending at a pouring mouth 5.

More specifically, the used flexible plastics material layers may be of any suitable type and, preferably, they are made of a food plastics material: in this way the collapsible can may also be used for holding drinking water and food liquids in general.

A main feature of the present invention is that on a slanted edge 10 of the collapsible can, near the mentioned elongated portion 4, there is provided a thickened portion 11, or plastics material rib embedded inside the two layers 2 and which may also be made by folding the two layer edges so as to provide the collapsible can with the desire stiffness.

With the mentioned thickened portion there are coupled two handle members 20 which are spaced at a given distance from one another.

More specifically, to said handle members 20 a belt element 21 may be coupled so as to afford the possibility of bearing the filled can on a user's shoulder.

As it should be apparent, moreover, the provision of said handle members 20 will facilitate the pouring of the liquid held in the collapsible can.

At the corner opposite to the can corner defining the elongated portion 4, which, in turn, defines the pouring mouth 5, there is provided an auxiliary handle member 25.

This auxiliary handle member can be made by simply coupling by adhesion the two layers or by interposing a plastics material comparatively stiff small plate.

At the pouring mouth 5 there are provided removable closure means, consisting of a small key 30 having an enlarged gripping head 31 therefrom extends a stem 32 which is provided with a slot 33.

Figure 5:
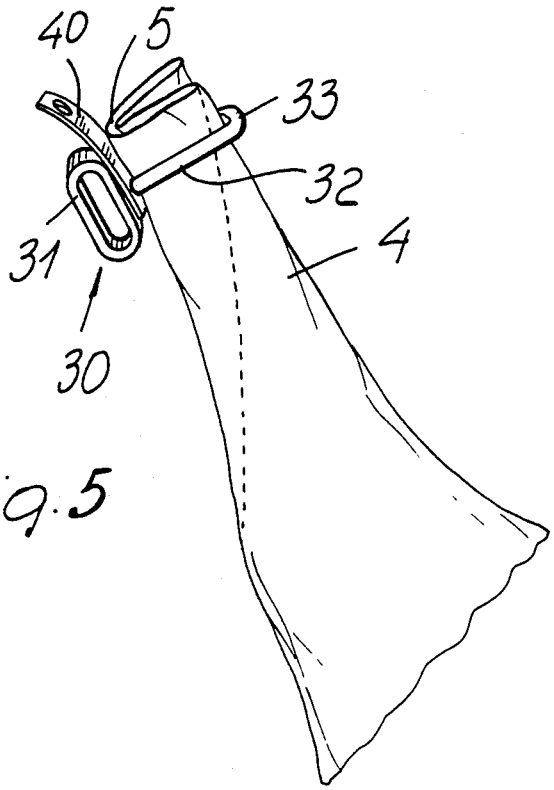
FIG. 5 shows the starting step for closing the collapsible can pouring mouth.
Figure 6:
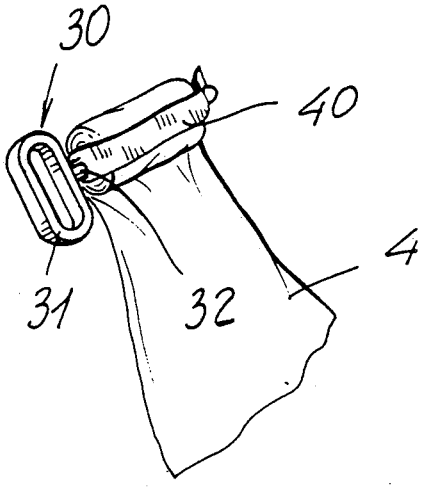
FIG. 6 illustrates a detail of the collapsible can mouth in its closed condition.
Figure 4:
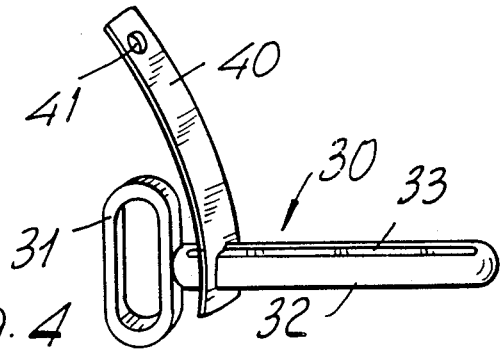
FIG. 4 is a perspective view illustrating means for removably closing the collapsible can mouth.

Into said slot 33, as is shown in FIG. 5, can be introduced the elongated portion 4 folded on itself.

After having introduced said elongated portion into said slot 33, the key 30 will be rotated so as to roll apart of said elongated portion on said key, so as to tightly close the pouring mouth.

The tightness of the closure is assured by a resilient cross member 40 which, at one end thereof, is coupled to the stem 32, at its enlarged portion 31 and, at the other hand, is provided with a throughgoing hole 41 adapted to receive the free end of the stem 32 so as to restrain the cross-member 40 on the rolled elongated portion thereby preventing it from unrolling and providing a tight closure.

From the above disclosure it should be apparent that the collapsible can according to the invention fully achieves the intended task and objects.

In particular, the fact is to be pointed out that the collapsible can according to the invention has a very flexible body, made from simple flexible plastics material layers, and, in the meanwhile, has the great advantage of assuming a stable shape thereby facilitating the pouring of the liquid held therein, which pouring operation is further facilitated by the gripping handle members arranged at the collapsible can corners.

Moreover, the provision of a closure key 30 provides the collapsible can with perfect tightness properties.

While the invention has been disclosed with reference to a preferred embodiment thereof, it should be apparent that it is susceptible to many modifications and variations all of which will come within the spirit and scope of the invention, as defined in the appended claims.

I claim:

1. A collapsible can having handle means for facilitating the pouring of a liquid held therein, comprising two flexible plastics material layers coupled to one another at their perimeter and including a pouring mouth arranged at one end of an elongated portion, there being moreover provided at least a gripping member attached to said can at a peripheral edge defined by said layers, near said elongated portion, and removable closure means associated with said pouring mouth, said at least a gripping element consisting of a handle attached to a thickened portion located at the peripheral edge of said collapsible can near said elongated portion.

2. A collapsible can according to claim 1, wherein said collapsible can comprises two spaced apart handles attached to said thickened portion.

3. A collapsible can according to claim 2, wherein said collapsible can comprises a belt element removably coupled to said two spaced apart handles.

4. A collapsible can according to claim 1, wherein said closure means consist of a key having an enlarged head from which a stem extends, said stem being provided with a slot adapted to removably receive a folded part of said elongated portion, to be rolled on said stem, there being moreover provided a resilient cross-member to prevent said elongated portion from unrolling.

* * * * *